US005359921A

United States Patent [19]

Wolff et al.

[11] Patent Number: 5,359,921

[45] Date of Patent: Nov. 1, 1994

[54] GUN BOLT ACCELERATOR MECHANISM

[75] Inventors: Peter C. Wolff, Georgia; Stephen J. Bullis, Colchester; Larry W. Hayes, South Burlington, all of Vt.

[73] Assignee: Martin Marietta Corporation, Philadelphia, Pa.

[21] Appl. No.: 83,553

[22] Filed: Jun. 29, 1993

[51] Int. Cl.[5] ..... F41A 5/08

[52] U.S. Cl. ..... 89/169

[58] Field of Search ..... 89/162, 169

[56] References Cited

U.S. PATENT DOCUMENTS 1,698,228 1/1929 Harring ..... 89/169

*Primary Examiner*—Stephen C. Bentley

*Attorney, Agent, or Firm*—Geoffrey H. Krauss

[57] ABSTRACT

A novel mechanism for moving a gun bolt toward and away from a firing chamber of a barrel assembly having movement relative to a receiver in a cartridge-firing weapon, having a camming channel formed in the receiver of the weapon, uses a rack member having an end coupled to the gun bolt and moving substantially linearly with the gun bolt toward and away from the chamber. A gear train has a housing affixed to the moving barrel assembly; an input member moves in the camming channel responsive to barrel assembly movement, to cause an output member to move the rack member and attached gun bolt toward and away from the chamber with substantially-linear displacement, velocity and acceleration greater than the associated displacement, velocity and acceleration of the moving barrel assembly with respect to the weapon receiver.

12 Claims, 10 Drawing Sheets

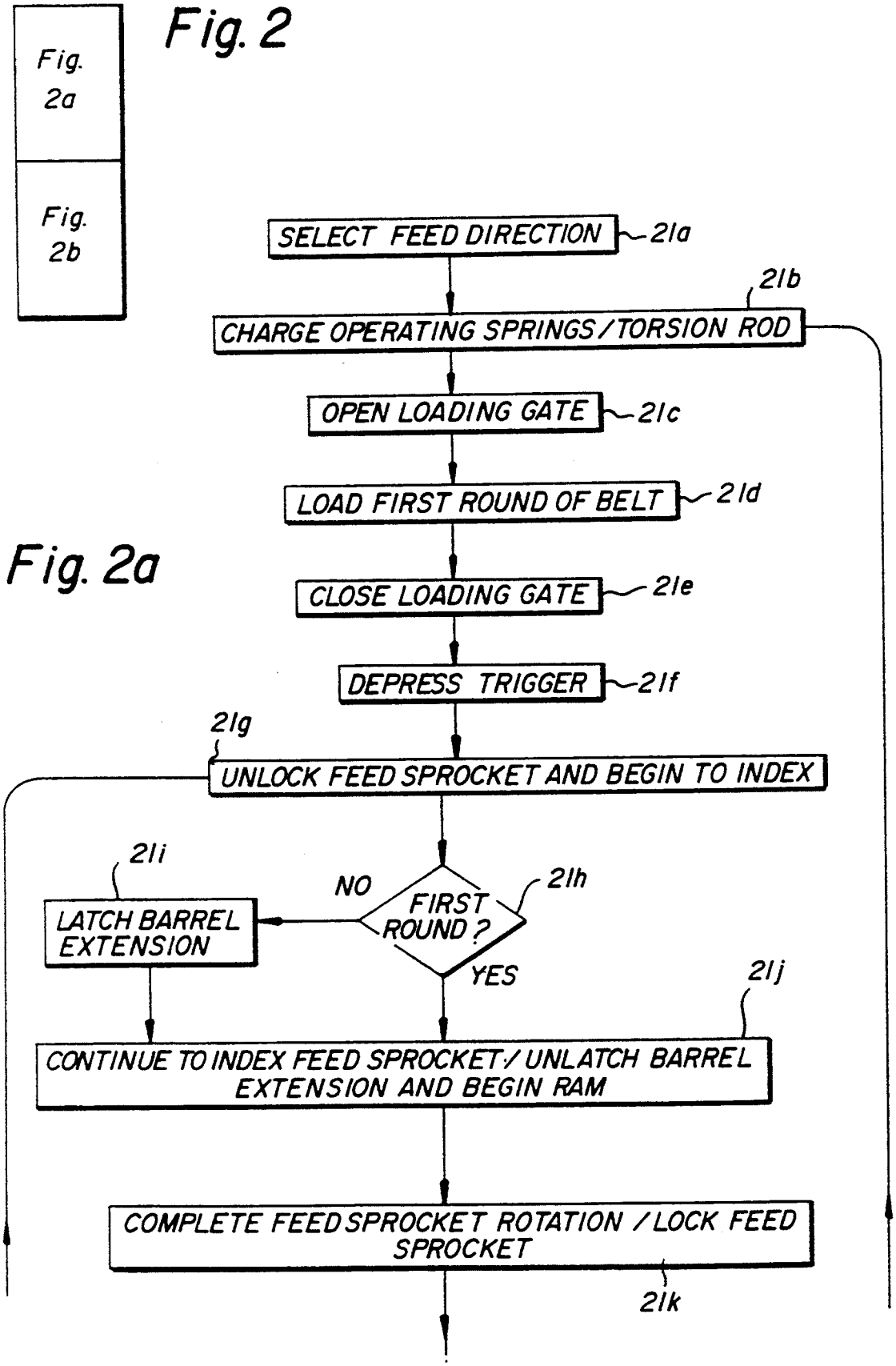
Fig. 2
Fig. 2a
Fig. 2b
SELECT FEED DIRECTION
21a
21b
CHARGE OPERATING SPRINGS/TORSION ROD
OPEN LOADING GATE
21c
LOAD FIRST ROUND OF BELT
21d
Fig. 2a
CLOSE LOADING GATE
21e
DEPRESS TRIGGER
21f
21g
UNLOCK FEED SPROCKET AND BEGIN TO INDEX
21i
NO
FIRST ROUND ?
21h
LATCH BARREL EXTENSION
YES
21j
CONTINUE TO INDEX FEED SPROCKET/UNLATCH BARREL EXTENSION AND BEGIN RAM
COMPLETE FEED SPROCKET ROTATION /LOCK FEED SPROCKET
21k 19
20
22
23
23a
23b
23c
23f
23s
23s'
23s''
14t
32a
20b''
20b'
41
34b
34d
3''
42
34
32
31
31b
31c
31d
34c
34a
45
4
20a
38a
32b
36c
151
38
20b
36
36W-l
36a
36W-a'
36W-r
36W-b
36b
34i
34g
34e
34f
41t
41c
40
42a
42l
42p
42b
42r
42e
44
32c

GUN BOLT ACCELERATOR MECHANISM

BACKGROUND OF THE INVENTION

The present invention relates to projectile-firing weapons and, more particularly, to a novel mechanism for accelerating a gun bolt toward and away from the firing chamber formed in a gun barrel, to respectively load and remove a cartridge into and from the chamber.

Modern weaponry often requires a fully automatic cartridge-firing gun in which apparent recoil force is minimized, even when a high rate-of-fire is provided. Such a weapon might beneficially use out-of-battery loading; however, with the attendant reciprocating barrel assembly movement, a special accelerator mechanism must provide the necessary forward acceleration (ramming) of the cartridge axially into the firing chamber, prior to firing, and rearward acceleration for the extraction of the spent cartridge. It is highly desirable to provide an accelerator mechanism that minimizes non-axial dimensions and movements, as well as one which provides axial movement over distances greater than the distance through which an initiating input must move. Most versatile operation dictates that the desired out-of-battery operation be provided with ambidextrous feed, i.e. with the weapon accepting feeding through either side of the receiver of a sequence of ammunition cartridges which are linked together in a belted configuration, and operating with the reciprocating barrel assembly.

BRIEF SUMMARY OF THE INVENTION

In accordance with the present invention, a novel mechanism for moving a gun bolt toward and away from a firing chamber of a barrel assembly having generally longitudinal movement relative to a receiver in a cartridge-firing weapon, includes: a camming channel formed in the receiver of the weapon; a rack member having an end coupled to the gun bolt and moving, along with the gun bolt, longitudinally toward and away from the chamber; and a gear train affixed to the moving barrel assembly and having an input member moving in the camming channel responsive to barrel assembly movement and causing an output member to longitudinally move the rack member and the gun bolt.

In a presently preferred embodiment, the gear train has a housing mounted to the movable barrel assembly, and has an input sector gear operating with an output gear via intermediate gearing selected to rotate the output gear teeth, meshed with teeth on the rack member, to longitudinally move the gun bolt with displacement, velocity and acceleration toward and away from said chamber greater than the associated displacement, velocity and acceleration of the moving barrel assembly with respect to the weapon receiver.

Accordingly, it is an object of the present invention to provide a novel gun bolt accelerator mechanism for moving a gun bolt toward and away from a barrel assembly firing chamber.

This and other objects of the present invention will become apparent upon reading of the following detailed description of a presently preferred embodiment, when considered in conjunction with the associated drawings.

BRIEF SUMMARY OF THE DRAWINGS

FIG. 3*b'* is a bottom view of a wing cam member used in the indexing mechanism;

FIG. 3*b''* is a plan view of a pawl member used in the indexing mechanism;

DETAILED DESCRIPTION OF A PREFERRED EMBODIMENT

Figure 1A:
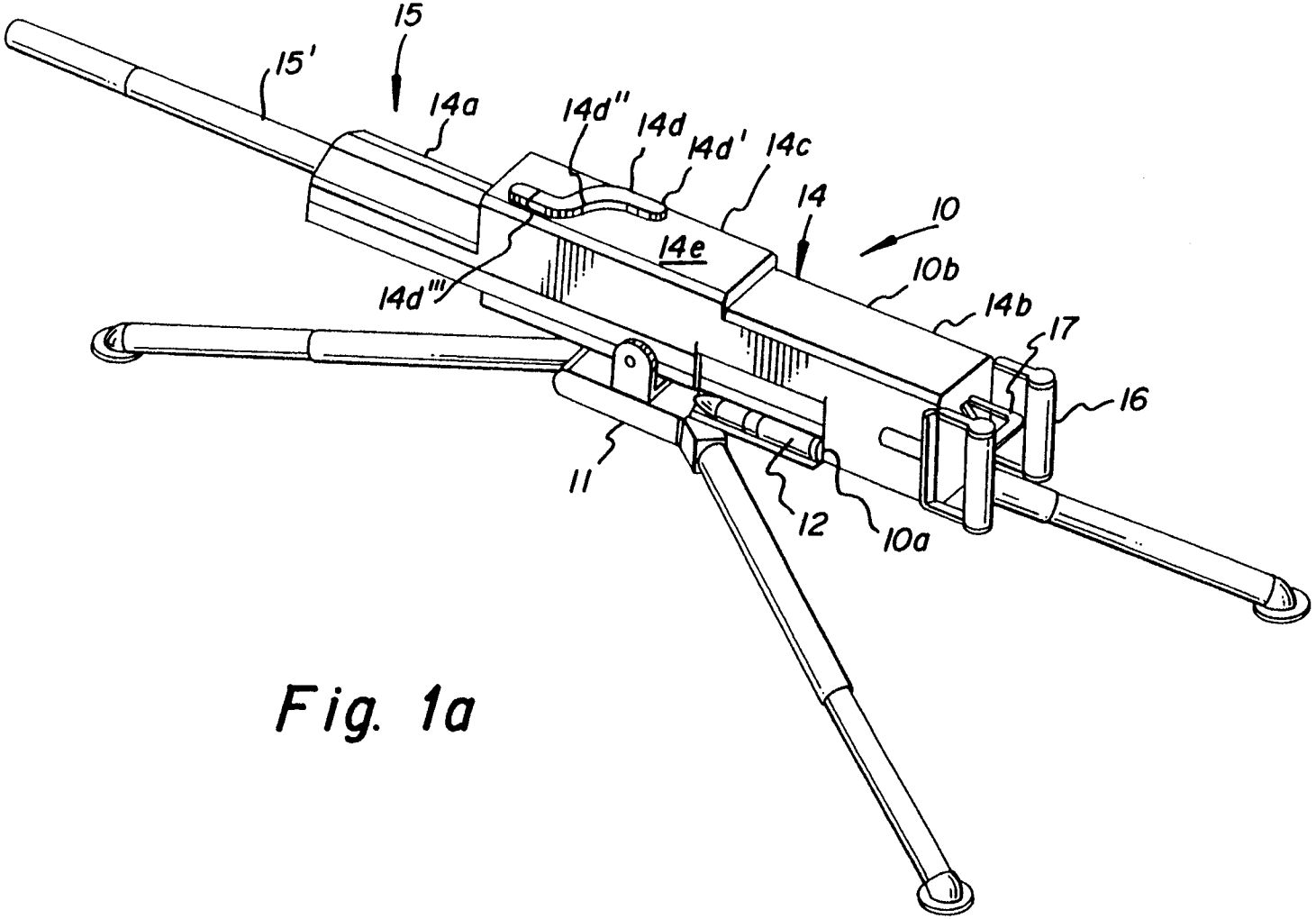
FIG. 1*a* is a prospective view of a weapon utilizing the present invention.
Figure 1B:
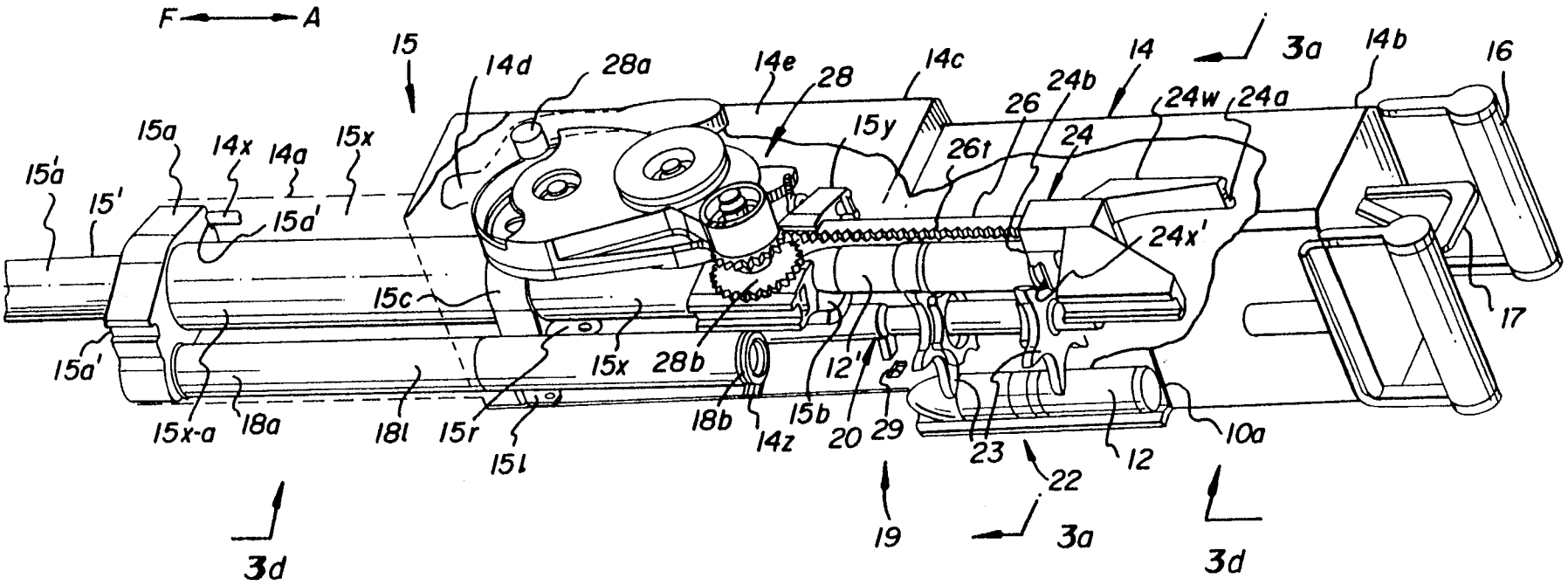
FIG. 1*b* is a partially-sectioned perspective view of the receiver portion of the weapon.

Referring initially to FIGS. 1*a* and 1*b*, a weapon assembly 10, mountable upon a tripod 11 and the like support mechanism, selectively fires one, a multi-shot burst or a steady stream of projectiles. A stream of cartridges 12 enter one feedport 10*a* of the weapon; there is a feedport adjacent each side of a gun receiver housing 14, with the left-hand feedport 10*a* being shown (an identical feedport 10*b* exists in a complementary position on the right-hand side of the weapon). The weapon includes a barrel assembly 15, having a rifled barrel 15' through which moves projectiles fired from cartridges 12, after the cartridges are moved into position in alignment with the axis of a barrel 15 and then rammed into a firing chamber 15*b* of the barrel, immediately prior to cartridge ignition; the empty, spent cartridge is then extracted by the bolt, moves back to its original position and is rotationally ejected. The stream of fired projectiles is directed by means of a training mechanism 16, utilized in conjunction with a trigger mechanism 17.

The receiver housing 14 has a forward end 14*a* and an aft end 14*b*, as well as an accelerator mechanism housing portion 14*c* including a camming channel 14*d* formed into the upper surface 14*e* thereof. Within forward receiver portion 14*a*, interchangeable barrel 15' fits within, and is retained by, a barrel extension 15*x*, so positioned as to allow the centered cartridge, or round 12', once indexed, or moved into alignment with the barrel axis 15'*a*, access to the barrel firing chamber 15*b*. The forward end 15*x*–*a* of barrel extension 15*x* is yoked, via a barrel extension yoke member 15*a*, to the forward ends 18*a* of right and left charging compression spring means 18*l* and 18*r* (see also FIG. 3*d*), whose opposite ends 18*b* are retained in formations 14*z* of housing 14. Charging spring tube ends 18*b* remain fixed, so that ends 18*a* may move rearward, under recoil or charging conditions; under such conditions the conjoint barrel 15', barrel extension 15*x*, and yoke 15*a* all move rearward from the position shown, along with a central yoke, or carrier, member 15*c*, joined to a midsection of the barrel extension, and having right and left cam-roller means 15*r*/15*l* carried thereon (see also FIG. 3*d*). That one of cam rollers 15*r*/15*l* actually in use will be determined by the selection of that one of feedports 10*a*/10*b* from which ammunition 12 is loaded. The direction of rotation of our novel feed indexing mechanism 19 will be determined, as will the twisting direction of torque means 20 when storing energy for operation of a cartridge movement means 22, by the pre-selection of a feedport 10*a* or 10*b*.

In the illustrated embodiment, means 22 operates by rotation of multi-tooth sprocket means 23, which will be caused to turn in either a clockwise direction (loading from left-hand port 10*a*), or in the counterclockwise direction (loading ammunition from the right-hand feedport 10*b*); the rotation here is through a 60° angle. The direction of mechanism 19 rotation is selected by operation of means 29 and determines, amongst other actions, which one of cam-roller mechanisms 15*r* or 15*l* is brought into contact with a portion of indexing mechanism 20.

The ammunition indexing activity associated with the torque-rotation indexing mechanism 20 occurs prior to a bolt means 24 being released from an aft position, to move forward and carry indexed cartridge 12' into barrel firing chamber 15*b*. Bolt means 24 is guided on channels 24*a* (see FIG. 3*a*) in bolt wings 24*w*, riding upon longitudinal extrusions 14*x* formed upon the interior surfaces of housing 14, for substantially longitudinal movement in the fore-aft directions. Barrel yoke 15*a* has similar channels 15*a'* operating with other portions of these extrusions 14*x*. Bolt means 24 is joined to a rack means 26, retained by an aft barrel extension yoke means 15*y* (itself having channels operating with the receiver extrusions 14*x*) to move the bolt face 24*b* generally longitudinally (e.g. along the centerline of the receiver) into contact with the rear of each cartridge, for accelerating the cartridge into the barrel firing chamber 15*b*. An accelerator mechanism 28, for accelerating gun bolt 24 towards and away from the barrel 15, includes a cam-roller 28*a*, moving in camming channel 14*d*, as the barrel extension 15*x*, upon which mechanism 28 is attached, moves longitudinally forward and aft, to turn an accelerator mechanism output gear 28*b*, which meshes with the teeth 26*t* of rack means 26, so as to move bolt means 24 forward and aft with displacements, velocities and accelerations greater than that of the barrel 15/barrel extension 15*x* combination.

Figure 2B:
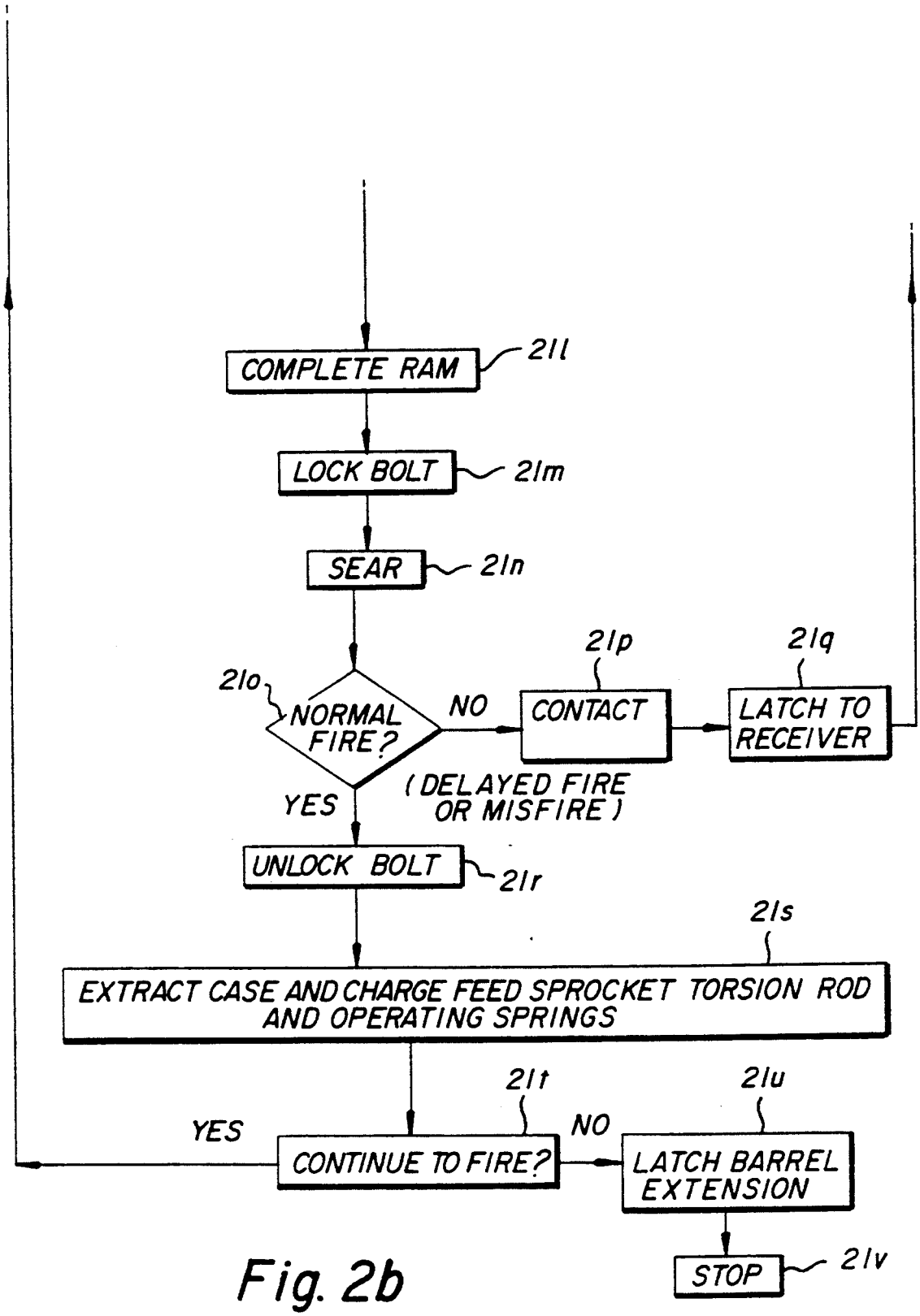
FIG. 2, comprised of FIGS. 2*a* and 2*b*, is a flow chart detailing the steps performed in the operation of the weapon utilizing the present invention.

Referring now to FIG. 2, the operation of weapon 10 follows the flow steps 21 illustrated: as previously mentioned, operation of weapon 10 commences (step 21*a*) with selection of the ammunition feed direction; a bottom-mounted feed direction selector 29 may be provided, for engagement of the proper one of cam-rollers 15*r* or 15*l*, and engagement of the proper pawl arm 42*p–l* or 42*p–r*, in torque energy-storage assembly 20 (to be discussed in more detail hereinbelow). After selector 29 is operated, step 21*b* is entered and the operating springs 18 and the torsion rod assembly 20 are charged (i.e. energy is stored therein) by moving rack mechanism 26 to its most extended condition, which carries bolt means 24, accelerator mechanism 28 and barrel assembly 15 to their rear-most positions. After the operating springs 18 are compressed, the barrel extension 15*x* is latched in this rearmost position (as described hereinbelow). A loading gate 10*c* (see FIG. 3*a*) covering the selected loading port 10*a*/10*b* is opened (step 21*c*) and the first round 12 in a belt of cartridges is loaded through the selected loading port (step 21*d*). Thereafter, the loading gate 10*c* is closed (step 21*e*) and the weapon is now "cocked" and ready to fire. The weapon can now be left in a "cocked and locked" condition; when weapon 10 is to be fired, trigger mechanism 17 is pressed (step 21*f*) and depression of trigger 17 causes a locking means 30' (FIG. 3*a*) to release a plunger 30 for movement, unlocking feed sprocket means 23 and allowing cartridge movement assembly 22 to rotate, under action of the torque energy-storage means 20, to rotate a cartridge 12 into chamber-aligned position (step 21*g*). The barrel extension 15*x* has a latch means 31, best shown in FIGS. 4*a* and 4*b*, and the condition of latch 31 is considered in step 21*h*; if a round has been immediately previously fired, the barrel extension 15*x* must have returned to the rearward position and be latched by member 31 (step 21*i*) before step 21*j* is entered, whereas if a round has not been previously immediately fired, the present round to be fired is considered the first round of a new sequence and step 21*j* is immediately entered from step 21*b*, because the barrel extension was previously latched. In step 21*j*, the feed sprockets 23 continue to turn until round 12 is indexed with the barrel, and then the barrel extension 15*x* is unlatched and begins to move forward, in the direction of arrow F, under the force of expanding charging springs 18, while accelerator mechanism 28 moves bolt means 24 to ram the indexed and aligned cartridge 12' into firing chamber 15*b*. Typically, barrel 15, barrel extension 15*x* and the firing chamber 15*b* thereof will move forward about four inches, in an out-of-battery loading action in which accelerator mechanism 28 causes bolt means 24 to move forward almost ten inches, so that the indexed cartridge 12' fully enters chamber 15*b*. When the feed sprocket 23 rotation is complete, utilizing the torque energy provided by torque assembly 20, cartridge movement means 22 ceases to move, sprocket member 23 is locked (step 21*k*) and step 21*l* is entered, signalling completion of forward ramming action of bolt means 24. At the forward bolt position, bolt means 24 is locked, by known means not shown, to the barrel aft yoke 15*y* (step 21*m*). After the bolt is locked to the barrel extension yoke, the sear operation (step 21*n*) occurs and the firing pin (also not shown) is actuated to initiate cartridge primer detonation. In the event that a normal cartridge detonation (step 21*o*) does not occur, the delayed fire or misfire occurrence will cause (step 21*p*) the forward-traveling barrel/extension/bolt mass to contact a buffer (not shown), and be latched to the receiver (step 21*q*); thereafter, operation returns to step 21*b*, wherein the torsion rod mechanism 20 and operating spring mechanism 18 must be recharged. If a normal cartridge detonation occurs in step 21*o*, after a delay to allow the projectile to exit the barrel, bolt means 24 is unlocked (step 21*r*) and the fired cartridge casing is extracted (step 21*s*) from barrel breach 15*b* during rear-ward recoil in the direction of arrow A, along with recharging of both the feed sprocket torsion rod means 20 and operating springs 18, as will be more fully discussed hereinbelow. Thereafter, step 21*t* is entered and the trigger 17 used to set means 30' to allow plunger 30 to determine either that firing will continue (with a return to step 21*g*), or that firing will cease, whereby step 21*u* is entered, and barrel extension 15*x* is latched by latch means 31, so that the mechanism stops (step 21*v*), but is in condition to re-commence firing when the trigger mechanism 17 is next actuated.

Figure 3A:
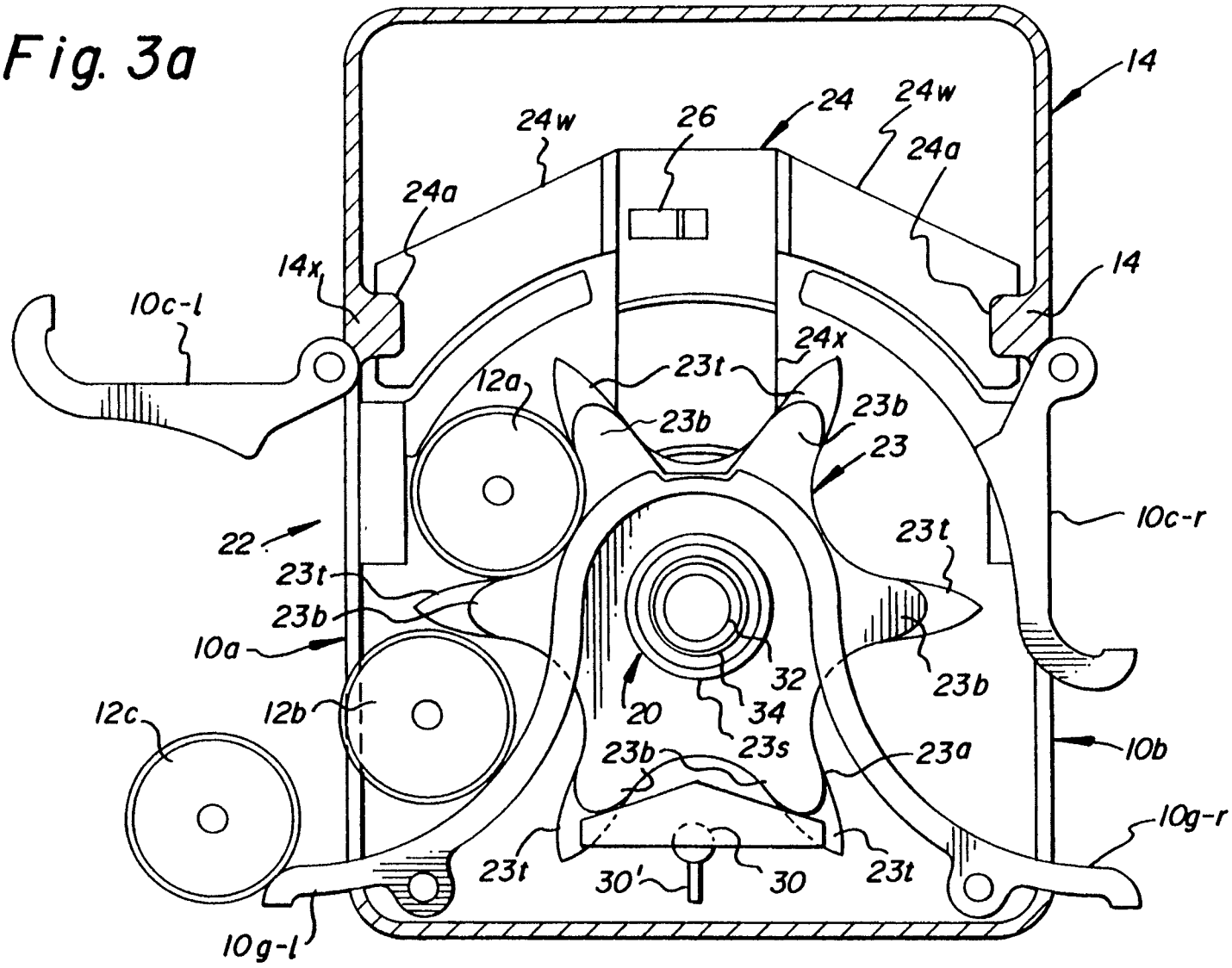
FIG. 3*a* is a sectional view of the weapon housing and of the ammunition loading mechanism, taken along the lines 3*a*—3*a* in FIG. 1*b;*

Referring to FIG. 3*a*, the cartridge loading steps involve selecting that one of left feedport 10 a or right feedport 10*b* through which a belt of linked cartridges 12 are to move; this selection may be started by movement of selector means 29, or may commence with opening the feedport cover 10*c* associated with the chosen direction (the cover then being linked to internal selector means) here, the left cover 10*c–l* has been opened and cartridge 12*a* has been placed between the pair of sprocket teeth 23*t* at the 10 o'clock position (as seen from the aft end of the weapon). The linked cartridges 12*a*, 12*b*, 12*c*, etc. are guided into the feedport on a guide means 10*g* (here, the left port guide rail 10*g–l*). Note the bolt means 24 and its bolt face extension 24*x*, which will be aft of the cartridge, once the cartridge is moved clockwise to the 12 o'clock position by the sprocket means 23 of the indexing mechanism.

Figures 3B, 3C:
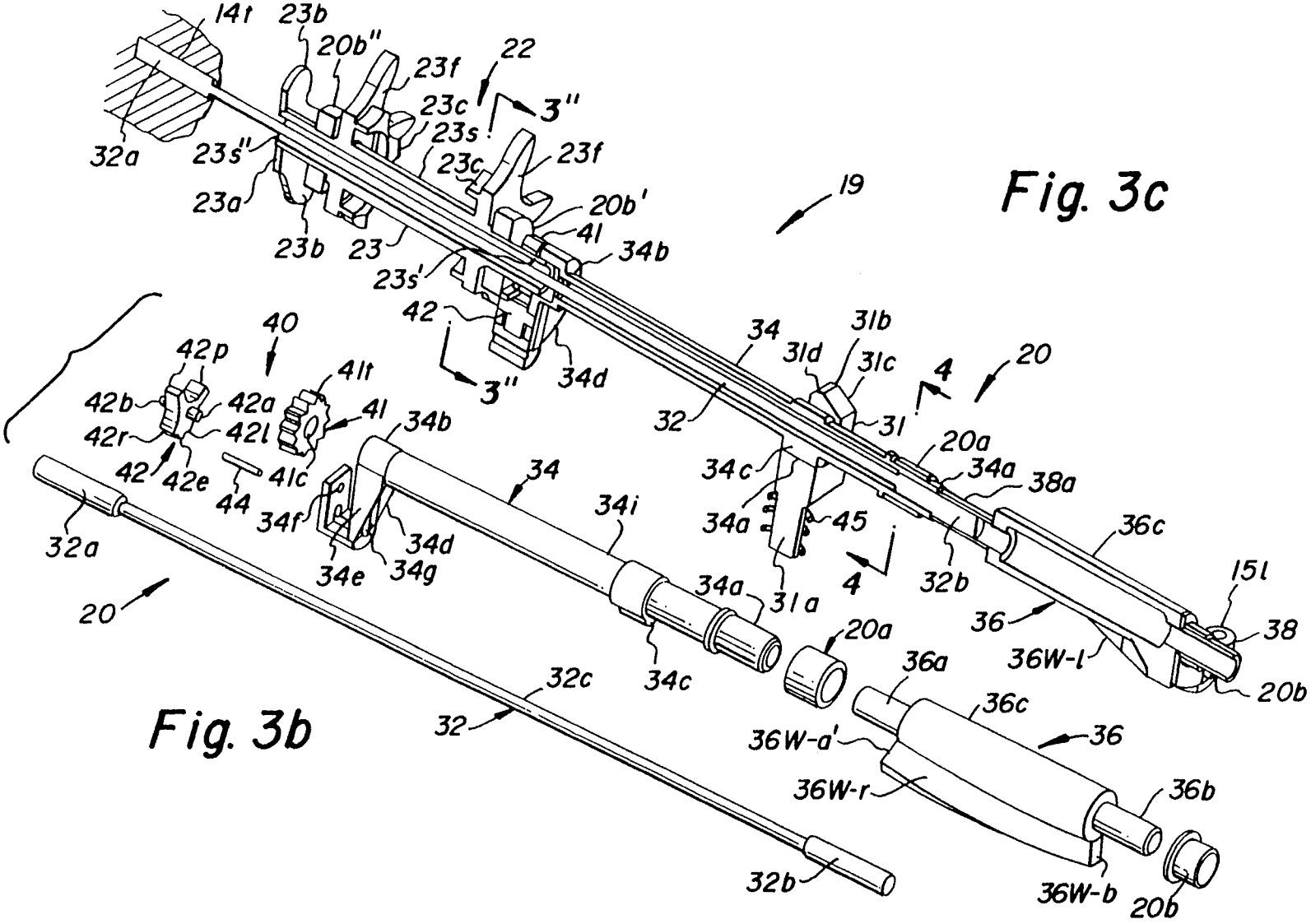
FIG. 3*b* is an exploded prospective view of a portion of the indexing mechanism.
FIG. 3*c* is a sectional prospective view of the ammunition loading mechanism.
Figure 3B:
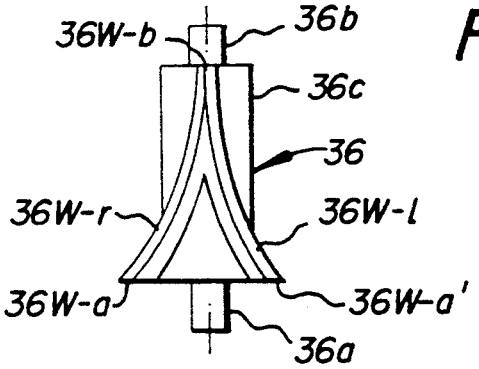
Figure 3B:
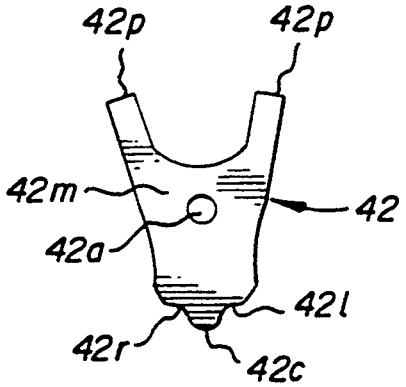
Figure 3D:
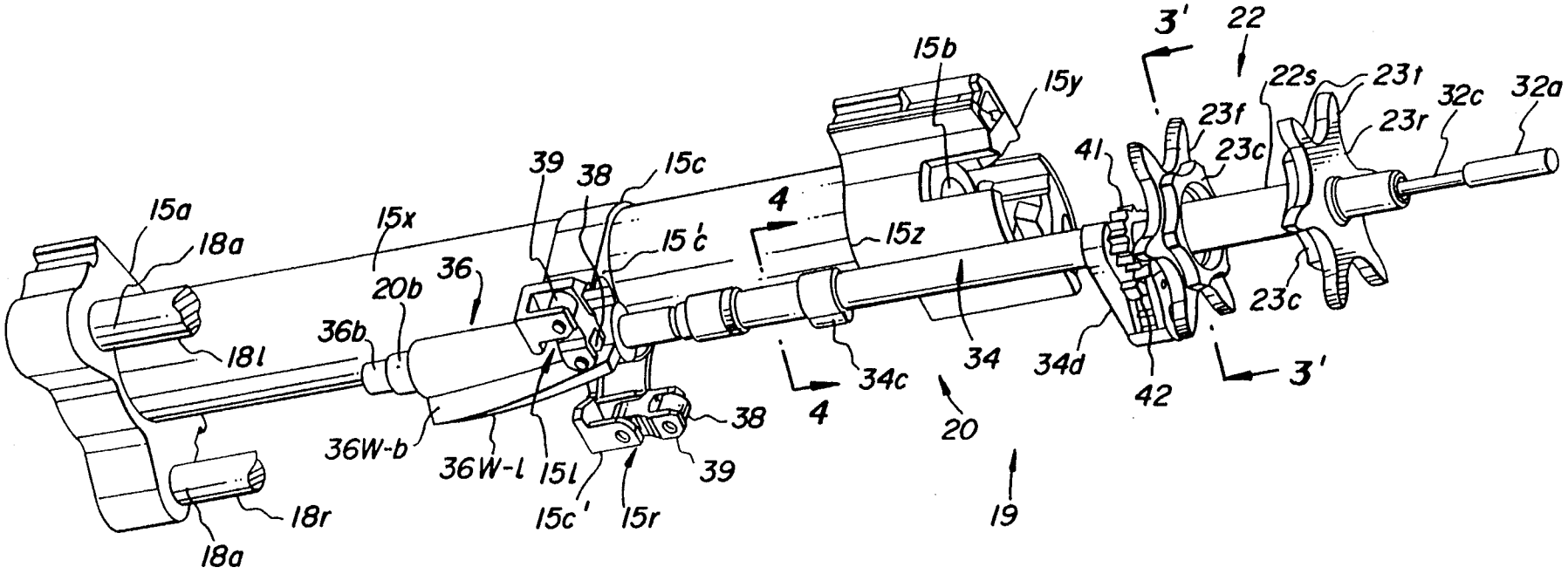
FIG. 3*d* is a bottom view of the indexing mechanism, taken along the lines 3*d*—3*d* in FIG. 2.

Referring now also to FIGS. 3*b–3d* and 3*b'*, the cartridge indexing mechanism 19 comprises torque energy-storage means 20 and cartridge movement 22. Torsion assembly 20 (FIG. 3*b*) has a central torsion rod 32 having a first end 32*a* which is immovably maintained within a housing aperture 14*t*. An opposite torsion rod end 32*b* is force fit into a first end 34*a* of a torsion tube 34, which coaxially encloses part of the central shaft 32*c* of the rod. A portion of rod end 32*b* is also force fit into a first end 36*a* of a wing cam member 36 which axially extends from torsion tube 34. Rod end 32*b* and its coaxial torsion tube end 34*a* and wing cam end 36*a* are supported by a support means 20*a*, such as a bushing or bearing. An opposite end 36*b* of wing cam member 36 is supported by another support means 20*b*. The wing cam 36 has a pair of camming wings 36*w* (best seen in FIG. 3*b'*) with a forward portion of the right cam wing 36W-r and a forward portion of the left cam wing 36W-l joined together in a unitary edge 36W-b adjacent to the cam front end 36*b* and curving into separated wing ends 36W-a/36W-a' adjacent to cam member aft end 36*a*. The outer camming surface of one of camming wings 36W is contacted by a selected one of rollers 38 of an active one of the pair of cam roller means 15*r* or 15*l*; the selection is responsive to feed selector means 29. In the illustrated embodiment, wherein left feedport 10*a* has been selected by means 29, left cam roller means 15*l* is moved such that its roller 38 is pressed against the left cam wing 36W-l (FIG. 3*d*) while the right cam roller 15*r* is moved such that its roller 38 is removed from the right cam wing. Each roller 38 is held by a clevis 39 arranged to the barrel extension carrier yoke member 15*c*. Thus, in the uncocked (rest) condition, the barrel and barrel extension are forward, so that carrier element 15*c* is sufficiently forward to cause roller 38 to abut the cam wing at the central end 36W-b thereof. As the mechanism is charged and the barrel extension is moved aft to charge operating springs 18, the barrel extension also moves carrier element 15*c* in the aft direction; the engaged roller 38 (here roller 38*l*) also moves aft and pushes against the abutting cam wing 36W (here, left wing 36W-l) to rotate the concentric torsion tube 34 and its coaxially-contained torsion rod 32 (here, in the counterclockwise direction, as seen from the aft or trigger-end of the housing).

An intermediate portion 34*i* of the torsion tube 34 carries a cam member portion 34*c*, which will be used to unlock the barrel extension 15*x*. The torque tube also carries at its aft end 34*b* a housing 34*d* for a ratchet-pawl means 40 which cooperates with the sprocket means 23 and the plunger means 30 (FIG. 3*a*) of the trigger mechanism, to rotationally lock the entire torsion indexing means 19, unless a round is to be fired. Means 40 includes a ratchet gear 41, having a central aperture 41*c* into which a forward extension 23*s'* of the shaft 23*s* of the sprocket means is fixed; a pawl 42 (see also FIG. 3*b''*) has a body member 42*m* with forward and aft axial extensions 42*a*/42*b* which fit into forward and aft apertures 34*e*/34*f* in the housing portion 34*d*. The pawl has a center lobe 42*c* between, and partially defining, first and second depressions 42*l* and 42*r*. A spring-loaded direction selector pin 44 operates in channel 34*g*, responsive to the feed-direction selector means 29, and is moved into one of depressions 42*l* (for left-hand feed) or 42*r* (for right-hand feed) selected to tilt the pawl member 42 such that the ratchet teeth 41*t* can be contacted by that one of the pawl arms 42*p* necessary to enable ratchet gear 41 rotation only in the correct feed direction, as will be explained with respect to FIGS. 3*e–3h* hereinbelow.

The cartridge movement assembly 22 has a sprocket means 23 with a sprocket tube 23*s* coaxially positioned about torsion rod 32; the tube has a forward end extension 23*s'* on which the ratchet gear 41 is mounted, and an aft end extension 23*s''* from which a buffer element 23*a* integrally extends. Extensions 23*s'* and 23*s''* are respectively journaled in respective support means 20*b'* and 20*b''*. Tube 23*s* is integrally joined to a forward toothed sprocket 23*f* and a rear toothed sprocket 23*r*. The sprockets each have the same number of axially-aligned teeth 22*t* (here, six teeth, each at a 60° angle to the adjacent pair of teeth), with buffer element 23*a* also having a plurality of lobes 23*b* not only equal in number to the number of cartridge-supporting teeth 23*t* on each of the sprockets 23*f* and 23*r*, but also in axial alignment therewith. A central reinforcement portion 23*c* is provided between the sprockets. As will be seen in FIG. 3*a*, the plunger 30 of the firing mechanism presses upward against two buffer element lobes 23*b*, to prevent the entire cartridge movement assembly 22, and the torque assembly 20 locked thereto, from turning, until the trigger 17 is depressed and means 30' releases plunger 30.

Referring now to FIGS. 3*e–3h*, taken in the direction of arrows 3''—3'' in FIG. 3*c* (i.e. looking forward from a position to the rear of the forward sprocket 23*f*, which is seen as if transparent), the ratchet pawl mechanism 40 is seen from the aft end. It will be understood that, once the barrel extension 15*x* is drawn back towards the receiver aft portion 14*b*, and torsional energy is stored in torsion assembly 20, prevention of indexing mechanism 19 from twisting in the opposite (untorqueing) direction is solely due to the blocking action of plunger 30 (see FIG. 3*a*). Once plunger 30 is released, the engaged arm 42*p* of the pawl pushes against an abutting tooth 41*t* of gear 41 (which is affixed, as by a spline, to the sprocket shaft extension 23*s'*), and rotation occurs in the opposite direction from the direction taken by the wing cam in storing the energy.

Consider first (FIGS. 3*e*/3*f*) the case of feeding from right-hand feedport 10*b*: the first cartridge 12*a* in a belt has been positioned at the 2 o'clock location, within the "pocket" 19*p* under right feedport cover 10*c–r* and is engaged by adjacent sprocket teeth 23*t;* the torsion rod 32/tube 34 of the indexing mechanism 19 had been torqued when the barrel extension was racked to the rear of the receiver and latched (either before or after the belt is loaded). Thus, as seen in FIG. 3*e,* the direction shaft 44 has been moved clockwise, to rest in the depression 42*r* clockwise of the pawl center lobe and select the right-hand feedport for use, and the torsion rod and tube were rotated in a clockwise direction, and locked thereat by the indirect action of the trigger means plunger; means 40 is now at the 8 o'clock position. When a round is to be fired, the plunger is released and the stored torque energy is transmitted, through pawl arm 42*p–r* to ratchet tooth 41*t,* so that the sprocket moves in the counterclockwise direction of arrow R, until means 40 is back at the resting 6 o'clock position (FIG. 30. Cartridge 12*a* has been rotated up to the 12 o'clock location, in line with, and ready for movement into, firing chamber 15*b.* Upon firing of cartridge 12*a,* the recoil moves the barrel/extension/cam roller assembly to the receiver rear 14*b,* and the right cam roller 38*r* operates on the associated cam wing 36W-r of the wing cam means 36 to twist the torque tube 34 and rod 32 in the clockwise direction, with the pawl arm 42*p–r* moving over a ratchet tooth 41*t,* into position for rotating the next cartridge 12*b* up to the 12 o'clock position.

Figure 3G:
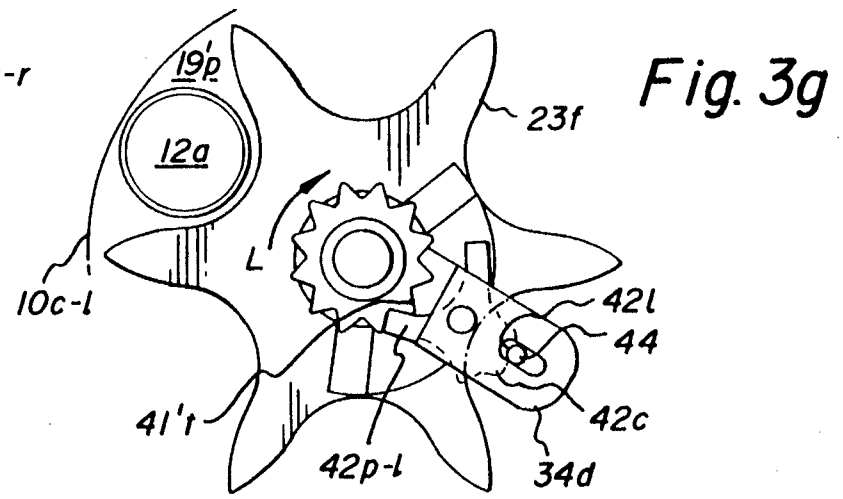
FIGS. 3*e*–3*h* are end views of the sprocket rachet pawl subassembly in the deenergized and energized conditions for respective right-hand and left-hand feed directions, as seen viewed in the direction of arrows 3'—3' in FIG. 3*d;*
Figure 3E:
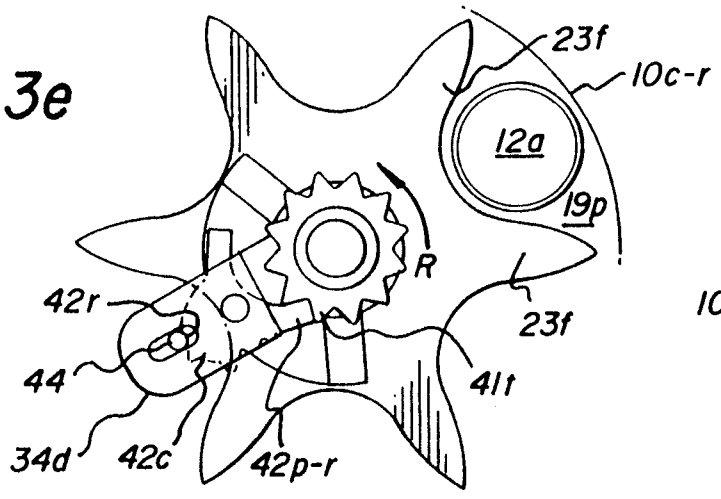
Figure 3H:
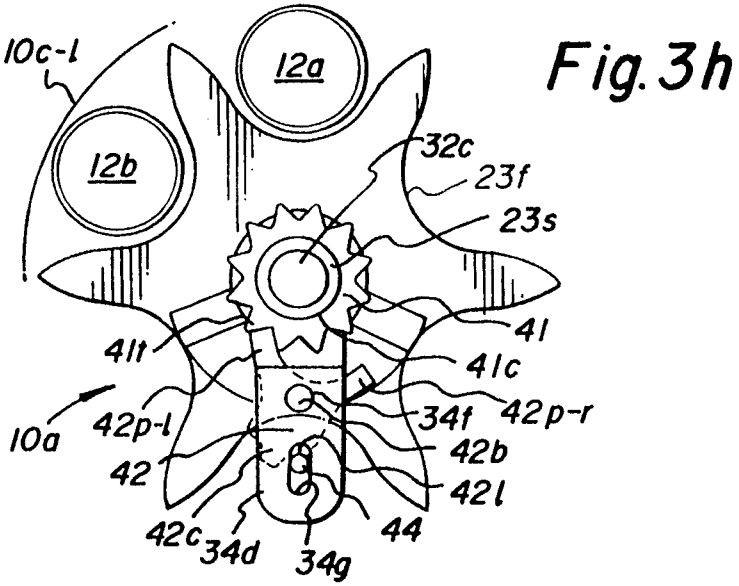
Figure 3F:
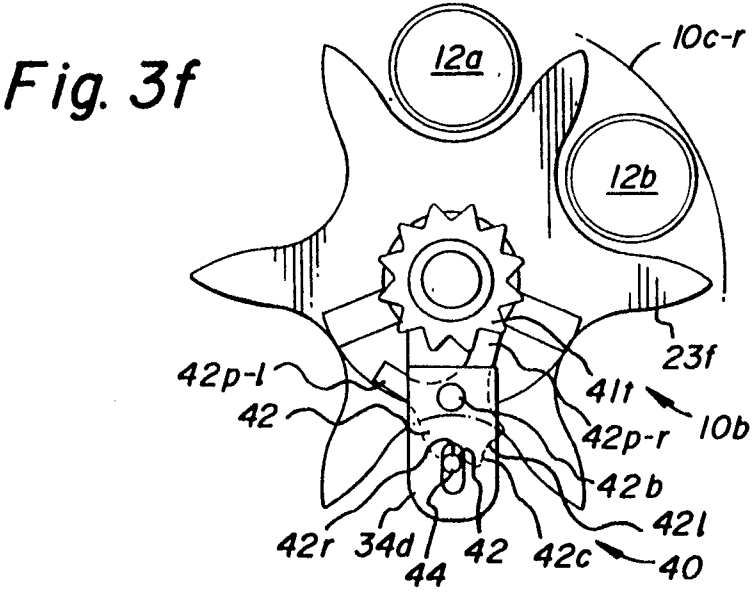

Consider now (FIGS. 3*g*/3*h*) the case of feeding from left-hand feedport 10*a:* the first cartridge 12*a* in a belt has been positioned at the 10 o'clock location in the pocket 19*p'* under the left feedport cover 10*c–l* and is engaged by adjacent sprocket teeth 23*t;* the torsion rod 32/tube 34 of the indexing mechanism 19 are torqued, as seen in FIG. 3*g,* to move means 40 counterclockwise to the 4 o'clock position, responsive to the direction shaft 44 having been moved to rest in the depression 42*l* counter-clockwise of the pawl center lobe 42*c* and select the left-hand feedport for use. When a round is to be fired, the plunger is released and the stored torque energy is transmitted, through pawl arm 42*p–l* to ratchet tooth 41*t,* so that the sprocket moves in the clockwise direction of arrow L, until means 40 is back at the resting 6 o'clock position (FIG. 3*h*). Cartridge 12*a* has been rotated up to the 12 o'clock location, in line with, and ready for movement into, firing chamber 15*b.* Upon firing of cartridge 12*a,* the recoil moves the barrel/extension/cam roller assembly to the receiver rear 14*b,* and the left cam roller 38 operates on the left cam of the wing cam means 36 to twist the torque tube 34 and rod 32 in the counterclockwise direction, with the pawl arm 42*p–l* moving over a ratchet tooth 41*t'*(actually, the face of the tooth opposite to the face over which the pawl arm 42*p–r* moves for the opposite feed direction), into position for rotating the next cartridge 12*b* up to the 12 o'clock position.

If release mechanism 30' allows the plunger to again be overridden by the sprocket lobes 22*b,* a next round is rotated into position and the entire firing sequence repeats. If, on the other hand, mechanism 30' does not allow plunger 30 to move and causes lobes 22*b* to be held, such that sprocket assembly 22 cannot rotate, the entire torsion assembly 19 remains in the torqued-up condition, ready to index a next round, as well as unlock the barrel and accelerator ram mechanism, for loading and firing the next round when the trigger mechanism is again activated to release plunger 30.

Figure 4A:
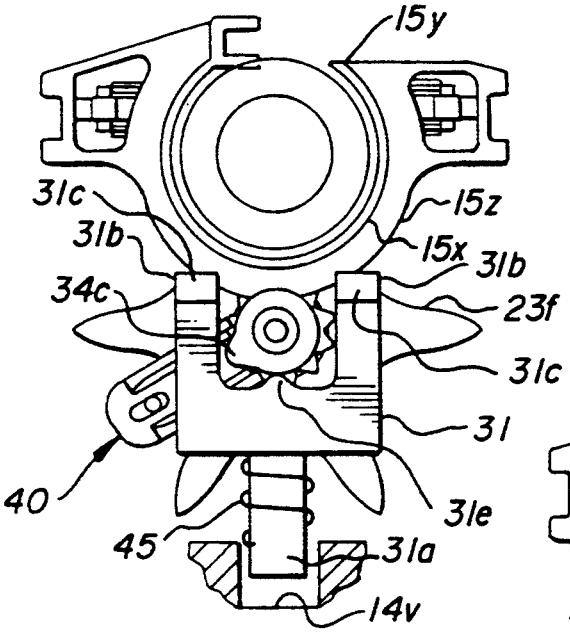
FIGS. 4*a* and 4*b* are sectional views of the barrel extension latch subassembly in the respective latched and unlatched conditions, as viewable in the direction of arrows 4—4 in FIG. 3*c; and*
Figure 4B:
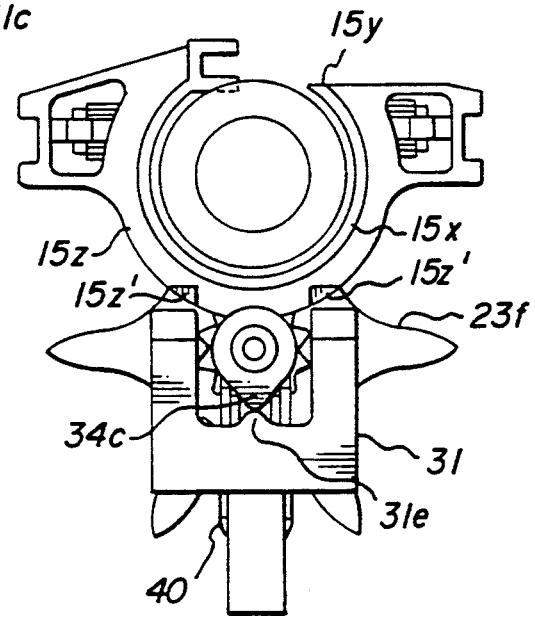

Referring now to FIGS. 4*a* and 4*b,* as seen looking in the direction of arrows 4—4 (see FIGS. 3*c*/3*d*), the barrel extension 15*x* is latched in the rearward position by the upward movement of a somewhat U-shaped barrel extension latch member 31, responsive to a spring means 45 formed about a latch extension 31*a,* moving in an aperture 14*v* in receiver foreportion 14*a.* The generally parallel latch arms 31*b* have canted forward edges 31*c* (see also FIG. 3*c),* over which the lower edge 15*z* of a portion of the barrel extension (e.g. rear yoke 15*y*) rides and is then prevented from returning forward by the rear latch edges 31*d,* which are raised by action of the return spring means 45. As the indexing means 19 is torqued-up, means 40 has been moved to the side (FIG. 4*a*) and the aligned camming lobe 34*c* is not contacting the camming formation 31*e* on the latch, so that the latch 31 is not depressed and its arms 31*b* remain in contact with the barrel extension yoke and prevent forward barrel motion. When the cartridge indexing mechanism 19 operates, the torque tube/rod is released for rotation and the camming lobe 34*c* rotates to urge formation 31*e* downward; arms 31*b* move down by an amount sufficient to allow the operating springs 18 to push the barrel extension forward, with lock portions 15*z'* passing over the latch arm ends 31*d;* further forward motion, under force of the compressed spring means 18 causes ramming of the cartridge into the firing chamber, where subsequent cartridge ignition occurs.

Figure 4C:
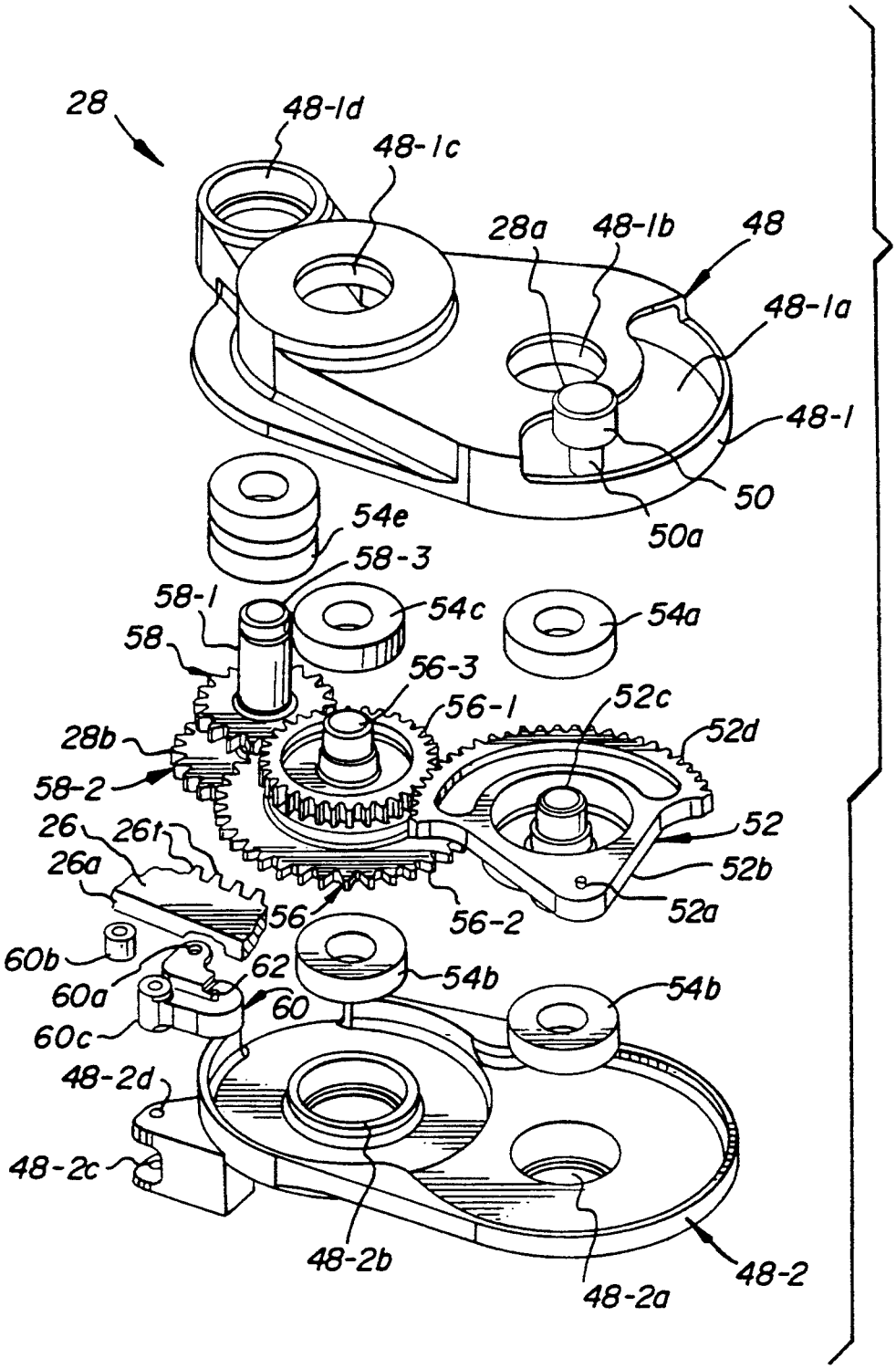
FIG. 4*c* is an exploded view of one presently preferred embodiment of the gun bolt accelerator mechanism of the present invention.

Referring now to FIG. 4*c,* in accordance with the present invention, the accelerator mechanism 28, for longitudinally moving the rack 26 and attached bolt means 24, has an accelerator housing 48 with an upper portion 48-1 and a lower portion 48-2 which is attached to the barrel extension 15*x.* The upper housing portion 48-1 has an arcuate aperture 48-1*a* formed to allow the camming roller 28*a,* at the outer end of an input member 50, to move along camming channel 14*d.* Member 50 has a shaft 50*a* which is affixed at an lobe 52*a* extended from the body 52*b* of a sector gear member 52; this gear has a central hub 52*c* adapted for rotation in support members 54*a*/54*b* and retaining apertures 48-1*b* and 48-2*a.* A sector gear member portion 52*d* extends over only a portion of the periphery of the gear member and has teeth of pitch and size to mate with teeth 56-1*a* of a first toothed gear portion 56-1 of a gear member 56, which also has a second toothed gear portion 56-2 joined thereto on a common shaft 56-3. Gear 56 is supported by means 54*c*/54*d,* in housing apertures 48-1*c* and 48-2*b.* The teeth of second gear portion 56-2 mate with the teeth of a first toothed gear portion 58-1 of a second gear member 58, having a second toothed gear portion 58-2 which provides the accelerator output 28*b* to the rack means 26. The second gear member 58 has a shaft 58-3 which is supported in upper housing aperture 48-1*d* by retainer means 54*e.* A pressure means 60, having a spring member 60*a* retained by a retention means 62 operating in apertures 48-2*c* of a lower housing extension 48-2*d,* presses a first pressure roller 60*b* against the back of the rack 26 (opposite the toothed edge 26*t* thereof) and uses the pressure against an opposite roller 60*c* to press the rack teeth into mesh with the accelerator output teeth 28*b.*

When the main operating spring means 18 is charged and the barrel/barrel extension 15*x* has been latched back in receiver 14, the accelerator roller cam 28*a* is at the rear end 14*d'* of the camming channel. Rack 26 has been extended and the bolt means 24 is at its maximum rearward extension from the barrel chamber 14*b.* This is the 'ready to trigger' position, in which a cartridge has not yet been rotated into alignment with the breech, much less been moved forward into the breech. When the trigger mechanism is activated, the abovedescribed cartridge indexing operation occurs, basically ending with the indexed cartridge 12' in alignment with, but behind, the breech. The barrel extension is unlatched (see FIG. 4b) and starts to move forward, under expansion of the charged operating spring means 18. As the extension 15x moves forward, the accelerator cam roller 28a rolls along channel 14d, from end 14d' through center portion 14d''; this movement rotates sector gear member 52 (say, through an angle on the order of 100°) and, via intermediate gears 56/58, rotates output 28b by an amount sufficient to cause rack 26 to move bolt means 24 forward into engagement with the barrel extension. The bolt face 24b contacts the rear of the cartridge and urges the cartridge forward, into the forward-moving breech (i.e. out-of-battery loading). The displacement, velocity and accelerator of bolt means 24 and cartridge 12, during forward movement thereof are, due to the overall gearing ratio, all greater than the associated displacement, velocity or acceleration of the barrel/extension. In one embodiment, the gearing of means 28 is such that about a 3.5" forward movement of the barrel extension 15x gives about a 6.3" forward movement, or ram, of the cartridge and bolt. We have designed means 28 such that the cartridge 12' is fully chambered at the end of camming channel section 14d'', so that the traversal of the short, straight section 14d''' can be used for locking the bolt to the barrel and for firing the cartridge.

Ignition occurs before the barrel assembly 15 reaches full forward position. Recoil then moves the barrel/extension back along portion 14d''', while the projectile traverses the barrel and the bolt is then unlocked from the extension. During the next rearward portion of travel of the extension, the cam roller movement through central portion 14d'' accelerates the bolt to the rear; the spent cartridge is retained to the bolt by extractor 24x. During spent cartridge movement to the rear, for extraction and ejection, the torque means 19 is being twisted and the main operating spring means 18 are being compressed, in preparation for firing a next round; the barrel/extension assembly locks in its rearmost position, by action of barrel latch 31, and the firing cycle ends.

While one presently preferred embodiment of our novel gun bolt accelerator mechanism has been described in detail herein, those skilled in the art will recognize that many modifications and variations thereof can be implemented. It is our intent to be limited only by the scope of the appending claims and not by way of the details and instrumentalities describing the embodiment shown herein.

What we claim is:

1. A mechanism for use in a cartridge-firing weapon for moving a gun bolt toward and away from a firing chamber of a barrel assembly having movement relative to a receiver, having a camming channel formed therein, comprising:

a rack member having a first end coupled to the gun bolt and a second end, and adapted for longitudinal motion with the gun bolt in said receiver toward and away from said chamber; and gear means having an input moved in the camming channel responsive to barrel assembly movement, relative to said receiver, for causing an output to move the rack member and attached gun bolt toward and away from the chamber with displacement, velocity and acceleration greater than the associated displacement, velocity and acceleration of the moving barrel assembly with respect to the weapon receiver.

2. The mechanism of claim 1, wherein said gear means includes: a housing affixed to the moving barrel assembly; a roller cam moving along said camming channel to impart motion to the means input; an output gear forming said means output coupled to said rack member; and intermediate gearing causing the gun bolt displacement, with respect to the moving barrel assembly, to be greater than the displacement of the moving barrel assembly with respect to the receiver.

3. The mechanism of claim 2, wherein said gear means input includes a sector gear having a center of rotation and an input lobe, offset from said center, upon which said roller cam acts.

4. The mechanism of claim 3, wherein said sector gear has a periphery and a plurality of teeth extending over only a portion of that periphery.

5. The mechanism of claim 4, wherein said teeth extend over less than 180° of said periphery.

6. The mechanism of claim 3, wherein said intermediate gearing provides a plurality of gear-gear intermeshings between said roller cam and the output gear.

7. The mechanism of claim 6, wherein a first gear member and a second gear member are used, each of having an input gear and an output gear, with the first gear member output gear intermeshing with the second gear member input gear, the input gear of the first gear member intermeshing with the input sector gear and the second gear member output gear forming the gear means output.

8. The mechanism of claim 1, wherein said gear means output comprises a member having teeth; and said rack member is an elongated member having teeth formed upon one side thereof and intermeshing with said gear means output teeth.

9. The mechanism of claim 8, further including resilient means for urging the rack member teeth into mesh with said gear means output teeth.

10. The mechanism of claim 9, wherein said urging means includes a spring member having a first end bearing a roller contacting a side of said rack member opposite to the tooth-bearing side.

11. The mechanism of claim 1, wherein the gear means causes the gun bolt to be moved over a displacement on the order of twice the displacement of the barrel extension causing the bolt displacement.

12. The mechanism of claim 1, wherein said camming channel is divided into an end portion and a remaining portion; movement of said gear means input along said end portion not causing any additional displacement of said gun bolt beyond the bolt displacement caused by the movement of said gear means input along said camming channel remaining portion.

* * * * *